US006243545B1

(12) United States Patent
Jewell

(10) Patent No.: US 6,243,545 B1
(45) Date of Patent: Jun. 5, 2001

(54) METHOD AND APPARATUS FOR CONTROLLING A BIAS OF A FIXING DEVICE

(75) Inventor: Robert W. Jewell, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/480,547

(22) Filed: Jan. 10, 2000

(51) Int. Cl.[7] ..... G03G 15/00; G03G 15/20
(52) U.S. Cl. ..... 399/67; 399/45
(58) Field of Search ..... 399/45, 66, 67, 399/320, 335

(56) References Cited

U.S. PATENT DOCUMENTS 5,291,253 * 3/1994 Kumasaka et al. ..... 399/66
5,608,506 * 3/1997 Omoto ..... 399/45 X
5,809,367 * 9/1998 Yoo et al. ..... 399/45
5,905,925 * 5/1999 Kawabata et al. ..... 399/45
6,111,594 * 8/2000 Jeong ..... 399/45 X

* cited by examiner

*Primary Examiner*—Fred L. Braun

(74) *Attorney, Agent, or Firm*—Gregg W. Wisdom

(57) ABSTRACT

A fixing device bias control system compensates for variations in media resistivity by controlling a bias supplied to a fixing device, such as a fuser, in an electrophotographic imaging device. Media resistivity may change dependent upon on the environmental conditions to which the media is exposed. A reduction in the moisture content of the media, as occurs after the first pass of a duplex imaging operation or in low humidity environments, will significantly increase the media resistivity. An increase in the resistivity of the media can result in toner adhering to the fuser, causing contamination on the fuser and image defects. The fixing device bias control system supplies a bias, having the same polarity as the charge on the toner, to a fusing roller included in the fuser to repel the toner, thereby reducing fuser contamination and image defects. In a first embodiment, the fixing device bias control system controls the bias based upon exposure of the media to the fixing process. The corresponding method includes controlling the bias to the fixing device according to whether the media has been previously exposed to the fixing process. In a second embodiment, the fixing device bias control system controls the bias based upon either a voltage or a current supplied to a transfer device. The corresponding method includes controlling the bias to the fixing device according to the voltage or current supplied to the transfer device.

20 Claims, 3 Drawing Sheets

METHOD AND APPARATUS FOR CONTROLLING A BIAS OF A FIXING DEVICE

FIELD OF THE INVENTION

This invention relates to electrophotographic imaging devices. More particularly, this invention relates to an improved method and apparatus for reducing image defects that may result from the fixing process.

BACKGROUND OF THE INVENTION

Electrophotographic imaging devices, such as electrophotographic printers, electrophotographic copiers, fax machines, and the like, form images on media by generating a latent electrostatic image on the surface of a photoconductor onto which pigment particles, such as toner, are developed, transferring the image formed on the surface of the photoconductor to the media, and fixing the toner to the media. The quality of the output is affected by the fixing operation. A problem that can occur during the fixing operation is known as "toner offsetting." Toner offsetting occurs when toner adheres to the fixing device and is placed on the media at a location offset from the desired location causing the formation of a double image. Another problem that can occur during the fixing process involves print defects occurring because of toner removed from the media accumulating on assemblies within the electrophotographic imaging device. Accumulated toner can break free from the assemblies and become deposited on the media, thereby causing a very visible print defect. A need exists for an apparatus and a method using the apparatus that will reduce the severity of these types of print defects.

SUMMARY OF THE INVENTION

Accordingly, a method for reducing contamination from toner in an electrophotographic imaging device includes determining a value of a parameter related to resistivity of media. Additionally, the method includes supplying a bias to a fixing device based upon the value of the parameter.

A fixing device bias control system for use in an electrophotographic imaging device including a fixing device to fix toner to media includes a power supply to provide a bias to the fixing device. In addition, the fixing device bias control system includes a controller configured to determine a first parameter related to resistivity of the media. The controller includes a configuration for configuring the power supply to supply the bias to the fixing device based upon the first parameter.

An electrophotographic imaging device to form an image on media using toner includes a photoconductor and a photoconductor exposure device to form a latent electrostatic image on the photoconductor. Additionally, the electrophotographic imaging device includes a developing device to develop the toner onto the photoconductor and a transfer device to transfer the toner from the photoconductor to the media. Furthermore, the electrophotographic imaging device includes a fixing device to fix toner to the media and a fixing device bias control system to provide a bias to the fixing device based upon a value of a parameter related to a resistivity of the media.

DESCRIPTION OF THE DRAWINGS

A more thorough understanding of embodiments of the fixing device bias control system may be had from the consideration of the following detailed description taken in conjunction with the accompanying drawings in which.

DETAILED DESCRIPTION OF THE DRAWINGS

Figure 1:
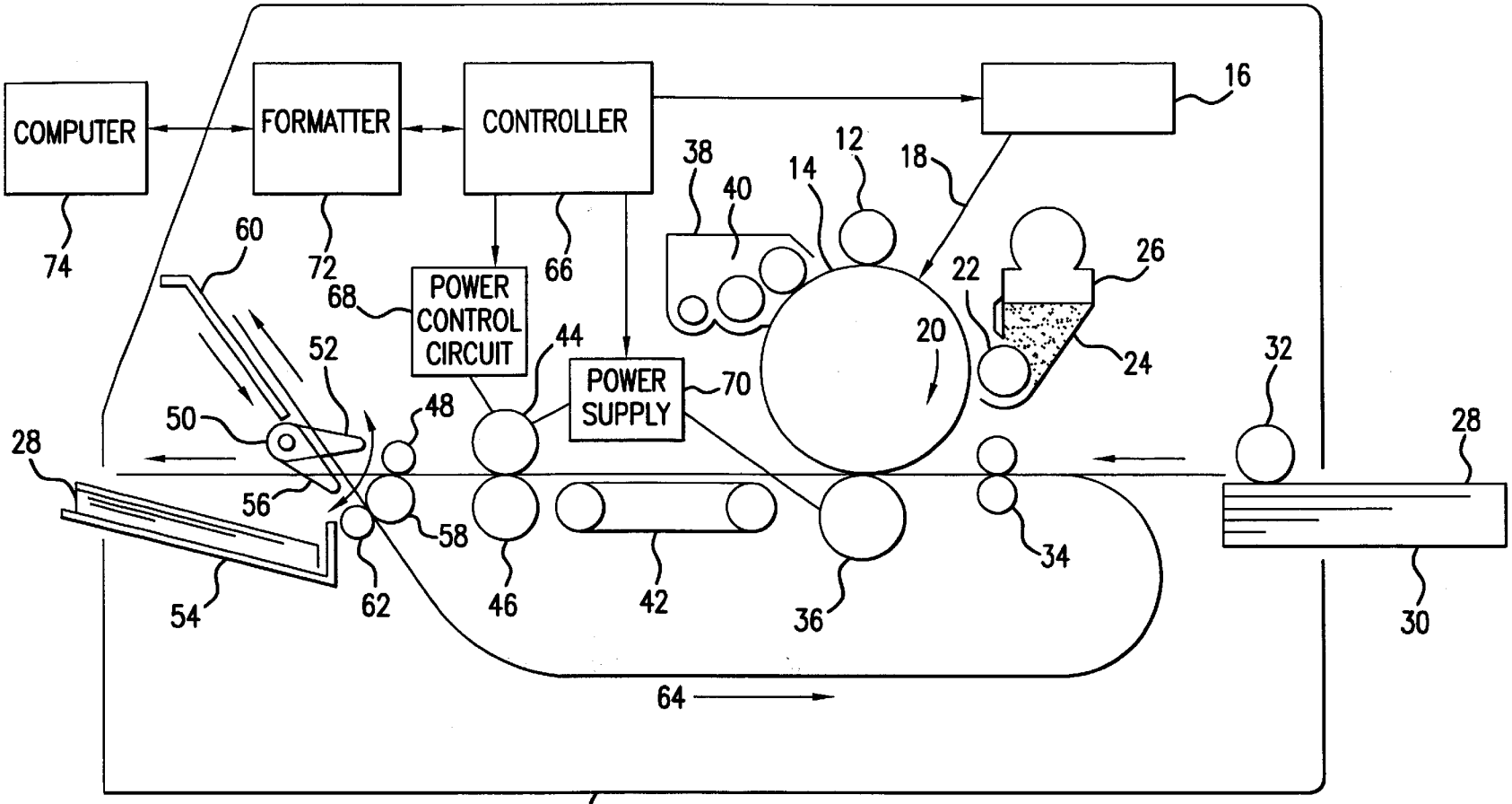
FIG. 1 shows a simplified schematic representation of an electrophotographic printer having duplex imaging capability and including an embodiment of the fixing device bias control system.

Referring to FIG. 1, shown is a simplified cross sectional view of an embodiment of an electrophotographic imaging device, electrophotographic printer 10, containing an embodiment of the fixing device bias control system. It should be recognized that although the disclosed embodiment of the fixing device bias control system is discussed in the context of a monochrome electrophotographic printer 10, it could also be used in other types of color or monochrome electrophotographic imaging devices, such as electrophotographic copiers, or it could be used in fax machines. Furthermore, although embodiments of the fixing device bias control system will be discussed in the context of electrophotographic printer 10 that includes the capability for duplex imaging, the fixing device bias control system may be put to beneficial use in electrophotographic imaging devices that are only capable of simplex imaging.

A charging device, such as charge roller 12, is used to charge the surface of a photoconductor, such as photoconductor drum 14, to a predetermined voltage. A photoconductor exposure device, such as laser scanner 16 includes a laser diode (not shown) for emitting a laser beam. The laser beam 18 is pulsed on and off as it is swept across the surface of photoconductor drum 14 to selectively discharge the surface of the photoconductor drum 14. Photoconductor drum 14 rotates in the clockwise direction as shown by the arrow 20. A developing device, such as developing roller 22, is used to develop the latent electrostatic image residing on the surface of photoconductor drum 14 after the surface voltage of the photoconductor drum 14 has been selectively discharged. Toner 24, which is stored in the toner reservoir 26, moves from locations within the toner reservoir 26 to the developing roller 22. A magnet located within the developing roller 22 magnetically attracts toner 24 to the surface of the developing roller 22. As the developing roller 22 rotates in the counterclockwise direction, the toner 24, located on the surface of the developing roller 22 opposite the areas on the surface of photoconductor drum 14 which are discharged, can move across the gap between the surface of the photoconductor drum 14 and the surface of the developing roller 22 to develop the latent electrostatic image.

Media, such as print media 28, is loaded from media tray 30 by pickup roller 32 into the media path of the electrophotographic printer 10. Print media 28 is moved along the media path by drive rollers 34. Print media 28 moves through the drive rollers 34 so that the arrival of the leading edge of print media 28 below photoconductor drum 14 is synchronized with the rotation of the region on the surface of photoconductor drum 14 having a latent electrostatic image corresponding to the leading edge of print media 28.

As the photoconductor drum 14 continues to rotate in the clockwise direction, the surface of the photoconductor drum 14, having toner adhered to it in the discharged areas, contacts print media 28 which has been charged by a transfer device, such as transfer roller 36, so that it attracts particles of toner 24 away from the surface of the photoconductor drum 14 and onto the surface of print media 28. The transfer of particles of toner 24 from the surface of photoconductor drum 14 to the surface of print media 28 is not fully efficient and therefore some toner particles remain on the surface of photoconductor drum 14. As photoconductor drum 14 continues to rotate, toner particles, which remain adhered to its surface, are removed by cleaning device 38 and deposited in toner waste hopper 40.

As print media 28 moves in the paper path past photoconductor drum 14, conveyer 42 delivers print media 28 to an embodiment of a fixing device, such as fuser 44. Fuser 44 could be an instant on fuser that includes a resistive heating element located on a substrate or a halogen bulb fuser that includes a halogen filled bulb heating element inside of a cylinder. Print media 28 passes between pressure roller 46 and fuser 44. Pressure roller 46 is coupled to a gear train (not shown in FIG. 1) in electrophotographic printer 10. Print media 28 passing between pressure roller 46 and fuser 44 is forced against fuser 44 by pressure roller 46. As pressure roller 46 rotates, print media 28 is pulled between fuser 44 and pressure roller 46. Heat applied to print media 28 by fuser 44 fixes toner 24 to the surface of print media 28. After the fixing operation, print media 28 passes under drive roller 48.

Electrophotographic printer 10 includes the capability for duplex imaging. If, after the image is fixed on a first side of print media 28 by fuser 44, no image is to be fixed on a second side of print media 28, directional gate 50 is held in first position 52. With directional gate 50 in first position 52, print media 28 is directed into output tray 54. However, if after the image is fixed on the first side of print media 28 by fuser 44, an image is to be fixed on the second side of print media 28, directional gate 50 is held in second position 56. In this case, driver roller 48 and driver roller 58 will move print media 28 up ramp 60. Then, after print media 28 clears driver roller 48 and driver roller 58, print media 28 will slide back into the nip region between drive roller 58 and drive roller 62 and follow the path corresponding to arrow 64. With print media 28 moving on the path indicated by arrow 64, the side of print media 28 opposite the side on which an image was previously formed will be orientated to face photoconductor drum 14. Thus, for duplex imaging, print media 28 will again pass through the electrophotographic imaging process.

By passing between fuser 44 and pressure roller 46 during the first pass of imaging, print media 28 was exposed to the high temperatures of the fusing process, typically in the range of 180 degrees centigrade. Exposure to the high temperatures of fixing removes moisture from print media 28. The removal of moisture from print media 28 changes its electrical characteristics. Specifically, the resistivity of print media 28 will increase with the removal of moisture. Typically, for paper media the moisture content ranges from 5% to 6% by weight, dependent upon the ambient temperature and humidity. The fixing operation typically reduces the moisture content to 3% by weight. As a rough approximation, the resistivity of print media 28 will increase an order of magnitude for each 1% by weight decrease in the moisture content. Thus, print media 28 having a typical resistivity of $10^6$ ohm-centimeters can change to $10^8$ ohm centimeters. The change of resistivity in print media 28 can have a significant impact upon the results of the fixing operation.

Transfer roller 36 charges the side of print media 28 opposite that facing photoconductor drum 14 through contact charging. In this charging operation, print media 28 forms part of the charging circuit. Positive charge is delivered by the power supply to print media 28. Consider the case in which the power supply providing the charging current to transfer roller 36 includes a voltage source. Typically, with a voltage source, the charging voltage is a DC voltage having a magnitude of approximately 2 KV. An increase in the resistivity of print media 28 will reduce the charging current that flows onto print media 28 and reduce the electric field between the surface of print media 28 facing photoconductor drum 14 and the surface of photoconductor drum 14. Reducing this electric field reduces the effectiveness of the transfer of the developed latent electrostatic image onto the surface of print media 28. In addition, because the magnitude of the charge on print media 28 is reduced, the electrostatic forces holding the transferred, but unfixed, image in place on the surface of print media 28 are reduced. This reduction in the electrostatic force holding the unfixed image onto print media 28 can result in disruption of the toner forming the image on print media 28.

Controller 66 is coupled to an embodiment of a power control circuit, power control circuit 68. A power control circuit controls the electric power supplied to a fixing device, thereby controlling the operating temperature of the fixing device. Power control circuit 68 controls the average electrical power supplied to fuser 44. Power control circuit 68 adjusts the number of cycles of the line voltage per unit time applied to fuser 44 to control the average power supplied to fuser 44. Controller 66 is also coupled to power supply 70. Power supply 70 supplies an adjustable bias to fuser 44 based upon a signal received from controller 66. By controlling the bias supplied to fuser 44 based upon a parameter or parameters related to the resistivity characteristics of print media 28 an improvement in the quality of the image fixed to print media 28 can be realized. These parameters could include one or more of the voltage supplied to transfer roller 36, the current supplied to transfer roller 36, or whether print media 28 has been through the fixing process one time or more than one time. Power supply 70 also provides voltages and currents to assemblies such as charge roller 12, developing roller 22, and transfer roller 36 to perform the electrophotographic imaging process. Controller 66 also provides the signals necessary for controlling the operation of the various assemblies (through the actuation of a drive motor and solenoids not shown in FIG. 1), such as the drive rollers and directional gate 52, necessary for moving print media 28 through either a simplex or duplex imaging operation.

The embodiment of the electrophotographic imaging device, shown in FIG. 1, electrophotographic printer 10, includes formatter 72. Formatter 72 receives print data, such as a display list, vector graphics, or raster print data, from the print driver operating in conjunction with an application program in computer 74. Formatter 72 converts these different types of print data into a stream of binary print data. Formatter 72 sends the stream of binary print data to controller 66. In addition, formatter 72 and controller 66 exchange the data necessary for controlling the electrophotographic printing process. This data includes information specifying whether a simplex or a duplex imaging operation is to be performed. In addition to controlling the various assemblies, controller 66 supplies the stream of binary print data to laser scanner 16. The binary print data stream provided by controller 66 to laser scanner 16 controls the exposure of photoconductor drum 14 by laser beam 18 to create the latent electrostatic image on photoconductor drum 14.

As previously mentioned, the resistivity of media is related to the moisture content of the media. A variety of factors affect the moisture content of the media. The ambient temperature, the ambient humidity, the prior exposure of the media to a heat source (such as a fixing device during a first pass of a duplex imaging operation) can all affect the media moisture content. In addition, the materials used in the media can affect the resistivity of the media either directly (because of the resistivity of the materials) or by affecting the amount of moisture retained by the media under ambient temperature and humidity conditions or after a first pass through a fixing device.

As indicated earlier, the resistivity of print media 28 affects the effectiveness of the transfer operation and electrostatic forces holding the un-fixed image on the surface of print media 28. As un-fixed toner on the surface print media 28 moves into the nip region between fuser 44 and pressure roller 46, electrostatic forces can pull un-fixed toner from the surface of print media 28 onto fuser 44. This movement of toner can result in several types of image defects.

In one type of image defect, un-fixed toner is removed from the surface of print media 28, adheres to the surface of fuser 44, and is deposited in a different location on the surface of print media 28. The toner adhering to the surface of fuser 44 can be redeposited on print media 28 on successive rotations of fuser 44. This type of image defect appears as a lower density copy of the image on the area from which the toner was removed, displaced one or more circumferences of the fuser on print media 28. This type of image defect is known as toner offsetting.

In another type of image defect, un-fixed toner is removed from the surface of print media 28, adheres to the surface of fuser 44 and collects on pressure roller 46. Typically, pressure roller 46 is not directly heated. Therefore, the surface temperature of pressure roller 46 is lower than that of fuser 44. Because of this temperature difference, the melted toner on the surface of fuser 44 solidifies when it contacts pressure roller 46 and thereby adheres to pressure roller 46. Over time, substantial amounts of toner can collect on pressure roller 46. When a sufficient amount of toner has collected on pressure roller 46, the toner will break free. Typically, the toner breaks free from pressure roller 46 and adheres to print media 28 passing between fuser 44 and pressure roller 46. Generally, the amount of toner that accumulates before breaking free from pressure roller 46 is sufficient to create a very noticeable image defect on print media 28.

The toner accumulated on fuser 44 and pressure roller 46 will not likely be completely deposited on a single unit of print media 28. More likely, the accumulated toner will cause image defects on multiple units of print media 28 in a random pattern. When this degree of contamination of fuser 44 or pressure roller 46 has occurred, reducing the image defects to an acceptable level may require replacement of the fixing assembly. By reducing the amount of toner that adheres to fuser 44 and pressure roller 46, the useful life of the fixing assembly will be extended and the number of print defects occurring will be reduced.

The embodiment of the fixing device bias control system included in electrophotographic printer 10 reduces the severity of image defects and extends the useful life of fuser 44 and pressure roller 46 by operating to reduce the un-fixed toner on print media 28 that is transferred onto fuser 44 and eventually pressure roller 46. To accomplish this, power supply 70 supplies a bias, such as a voltage to fuser 44. The bias supplied to fuser 44 creates an electric field between fuser 44 and pressure roller 46. It should be recognized that the bias supplied to fuser 44 by power supply 70 could include either a substantially non-time varying bias (such as a DC voltage) or the bias supplied to fuser 44 by power supply 70 could include a time varying bias (such as a DC voltage having a superimposed square wave or sine wave voltage). The term substantially non-time varying as used in this specification means that the bias would have a magnitude that would stay within a range dependent upon non-ideal characteristics of power supply 70 or electrical noise on the output of power supply 70 used to supply the bias to fuser 44.

The polarity of the bias selected is the same as that of the charge of the un-fixed toner on print media 28 so that toner is repelled from the surface of fuser 44 and remains upon print media 28. For example, in an electrophotographic imaging device using negatively charged toner, the polarity of the applied bias would be negative. The magnitude of the bias supplied to fuser 44 is dependent upon a characteristic of print media 28 related to its resistivity. As the characteristic of print media 28 changes to reduce the force with which un-fixed toner is held to the surface of print media 28, the magnitude of the bias supplied to fuser 44 is increased to compensate for this change. The characteristic of print media 28 that changes may be determined directly, or may be determined by monitoring conditions known to affect the characteristic.

In a first embodiment of the fixing device bias control system, the bias supplied to fuser 44 is determined based upon print job related information supplied by computer 74 to formatter 72. Included with the print data supplied by computer 74 to formatter 72 during the start of a print job is information specifying whether the print job includes duplex printing or simplex printing. Subjecting print media 28 to the second pass of the electrophotographic imaging process will increase its resistivity (because of moisture loss from the fixing operation) thereby resulting in a decrease of the electrostatic force holding the un-fixed toner onto the surface of print media 28 on the second pass of the electrophotographic imaging process. Formatter 72 passes the information specifying whether imaging is to be performed in a duplex or simplex mode to controller 66. Controller 66 uses this information to set the bias applied to fuser 44. The magnitude of the bias applied to fuser 44 ranges between 500 volts and 750 volts. During the first pass of the electrophotographic imaging process, a bias of −500 volts is applied. During the second pass of the electrophotographic imaging process, a bias of −750 volts is applied to compensate for the decreased attraction between the toner and print media 28.

Figure 2:
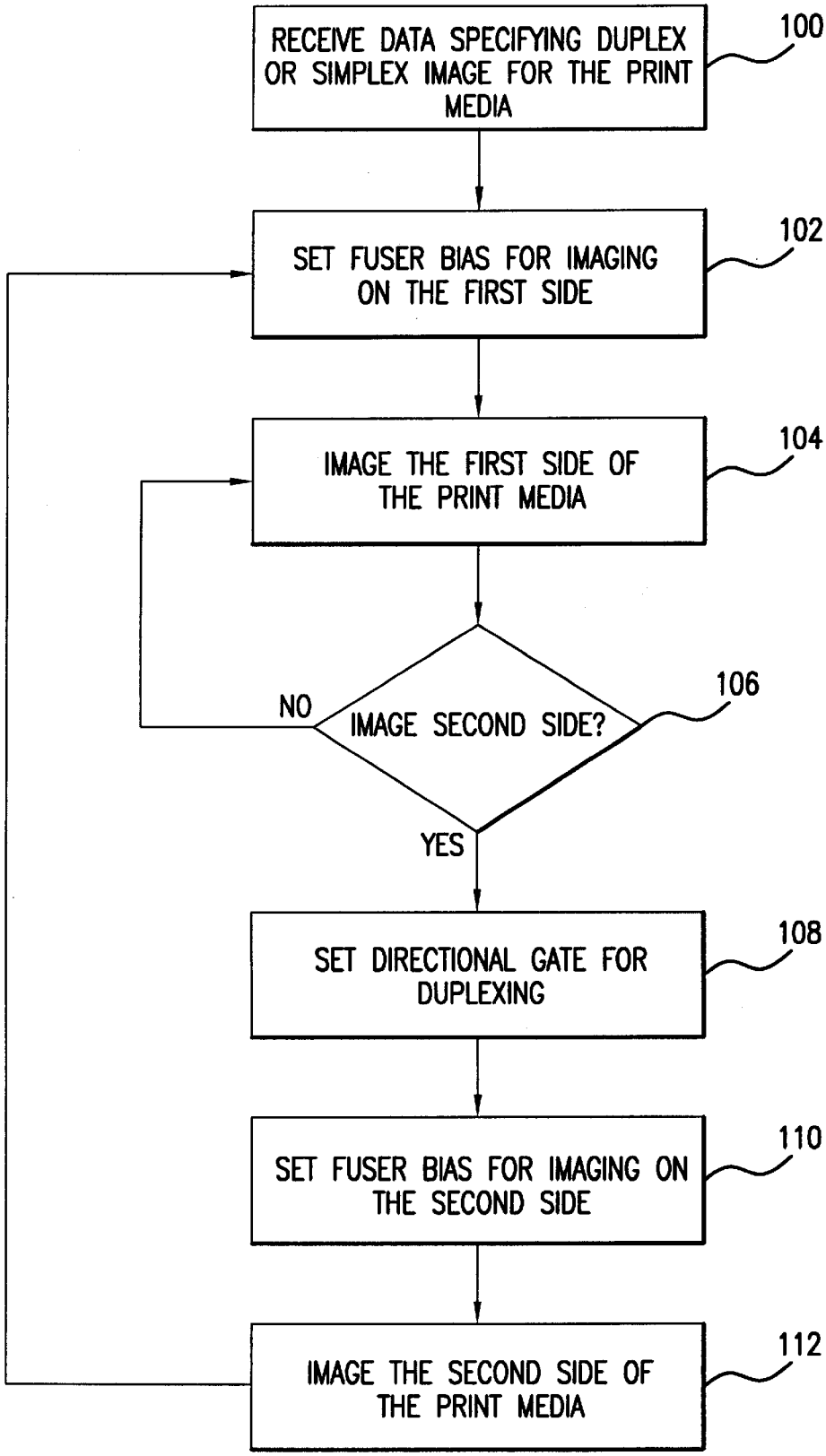
FIG. 2 shows a high level flow diagram of a method for using a first embodiment of a fixing device bias control system.

Shown in FIG. 2 is a high level flow diagram of a method for using the first embodiment of the fixing device bias control system. First, in step 100, electrophotographic printer 10 receives data from computer 74 specifying on which units of print media 28 duplex imaging will be performed. Next, in step 102, controller 66 sets the bias on fuser 44 at −500 volts using power supply 70 in preparation for imaging on the first side of print media 28 of the print job. In step 104 imaging is performed on the first side of print media 28. After imaging on the first side of print media 28 is complete, in step 106, controller 66 determines if imaging is to be performed on the second side of print media 28. If imaging will not be performed on the second side, then control is returned to step 104 for the next unit of print media 28. If imaging is to be performed on the second side, in step 108, controller sets directional gate 50 to second position 56 for performing a duplex imaging operation. Then, in step 110, controller 66 sets the bias supplied to fuser 44 by power supply 70 at −750 volts in preparation for imaging on the second side of print media 28. Finally, in step 112, imaging is performed on the second side of print media 28. After completing imaging and fixing operation on the first unit of print media 28 of the print job, control is returned to step 102 for imaging the next unit of print media 28.

In a second embodiment of the fixing device bias control system, the bias supplied to fuser 44 is determined based upon the output of power supply 70 supplied to transfer roller 36. Power supply 70 can be configured to supply a substantially constant voltage or a substantially constant current to transfer roller 36. If power supply 70 is configured to supply a substantially constant voltage to transfer roller 36, controller 66 includes a configuration to monitor the current supplied by power supply 70 to transfer roller 36. In this case, the current supplied by power supply 70 during the transfer operation will be indicative of the resistivity of print media 28. As the moisture content of print media 28 drops, its resistivity increases and the current supplied by power supply 70 will decrease during the transfer operation. Firmware operating in controller 66 will use the monitored value of current to access a lookup table containing data used to set the bias supplied to fuser 44 by power supply 70. Alternatively, controller 66 may directly compute the value of the bias voltage to be supplied to fuser 44 based upon the monitored current value.

The lookup table values are empirically determined so that the worst case minimum current (over the full range of variability for the resistivity of print media 28) supplied by power supply 70 to transfer roller 36 will correspond to the maximum magnitude of the bias voltage supplied to fuser 44. Similarly, the worst case maximum current will correspond to the minimum magnitude of the bias voltage supplied to fuser 44. Lookup table bias voltage values for values of current between the worst case maximum and worst case minimum are determined by interpolating between the maximum and minimum magnitude of the bias voltage. Alternatively, these lookup table bias voltage values may be determined empirically for media having resistivity between the maximum value and the minimum value.

If power supply 70 is configured to supply a substantially constant current to transfer roller 36, then controller 66 is configured to monitor the voltage supplied by power supply 70 to transfer roller 36. In this case, the voltage supplied by power supply 70 during the transfer operation will be indicative of the resistivity of print media 28. As the moisture content of print media 28 drops, its resistivity increases and the voltage supplied by power supply 70 will increase during the transfer operation in an attempt to maintain a constant current flow into transfer roller 36. Although more sophisticated electrophotographic imaging devices use a current source to supply the transfer roller to compensate for media resistivity variations, the capability of the current sources used does not generally allow for full compensation of the effect of media resistivity variation. For higher levels of resistivity of print media 28, the output voltage of power supply 70 will reach its upper limit before the current supplied reaches its substantially constant value during nominal operation. Firmware operating in controller 66 will use the monitored value of voltage to access a lookup table containing data used to set the bias supplied to fuser 44 by power supply 70. Alternatively, controller 66 may directly compute the value of the bias voltage to be supplied to fuser 44 based upon the monitored voltage value.

The lookup table values are empirically determined so that the worst case maximum voltage (over the full range of variability for the resistivity of print media 28) supplied by power supply 70 to transfer roller 36 will correspond to the maximum magnitude of the bias voltage supplied to fuser 44. Similarly, the worst case minimum bias voltage will correspond to the minimum magnitude of the bias voltage supplied to fuser 44. Lookup table bias voltage values for values of transfer roller voltage between the worst case maximum and worst case minimum are determined by interpolating between the maximum and minimum magnitude of the bias voltage. Alternatively, these lookup table bias voltage values may be determined empirically for media having a resistivity between the maximum value and the minimum value.

Figure 3:
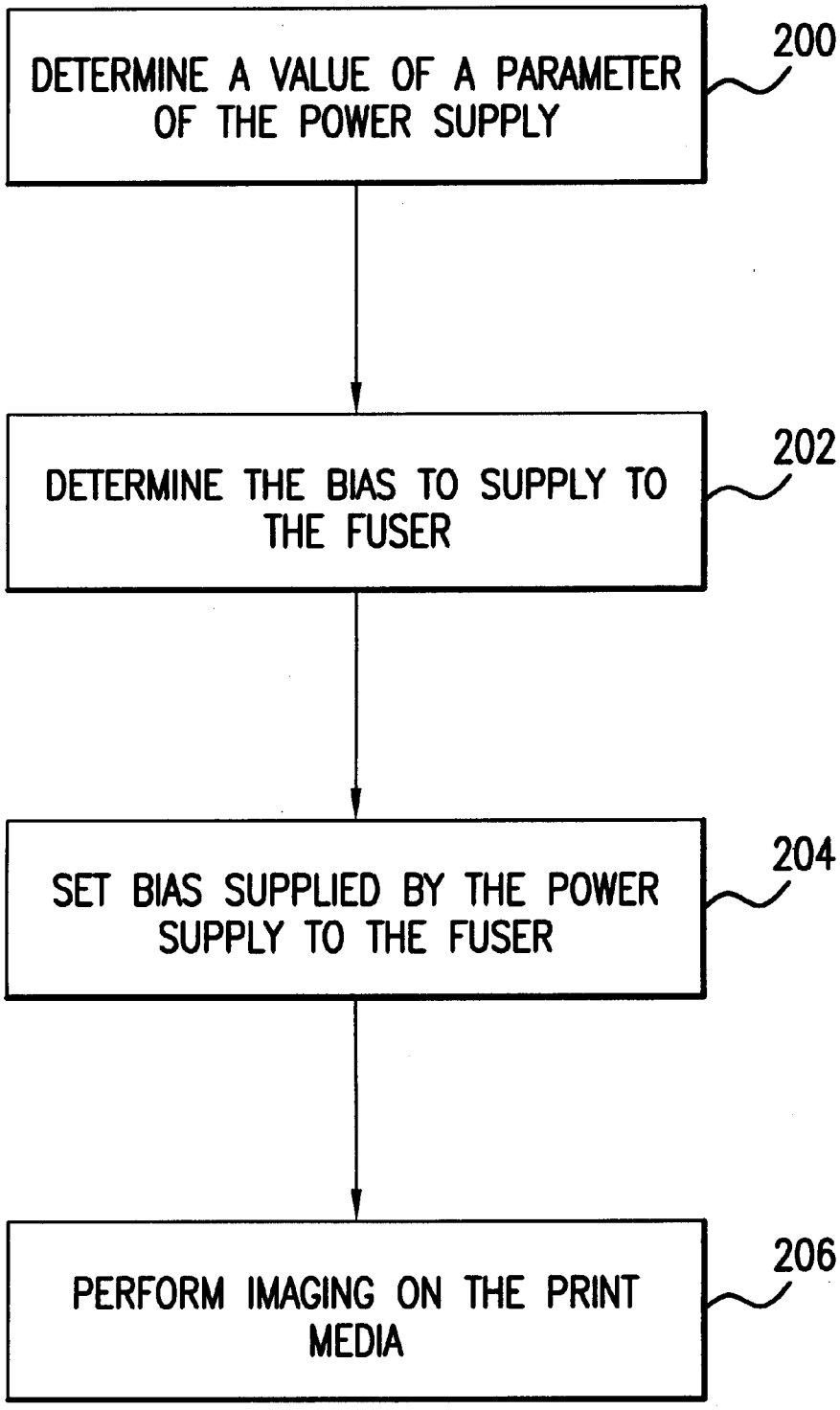
FIG. 3 shows a high level flow diagram of a method for using a second embodiment of the fixing device bias control system.

Shown in FIG. 3 is a high level flow diagram of a method for using either of the alternatives of the second embodiment of the fixing device bias control system. In a first step 200, prior to fixing a unit of print media 28, controller 66 determines a value of a parameter of power supply 70 related to either the current or voltage supplied by power supply 70 to transfer roller 36. Then, in step 202, controller 66 determines the bias that should be supplied to fuser 44 to compensate for the resistivity of the unit of print media 28 upon which fusing will be performed. Controller 66 may make this determination by accessing a lookup table based upon the value determined for the parameter or by performing a computation based upon the value determined for the parameter. Next, in step 204, controller sets the bias supplied by power supply 70 to fuser 44 according to the bias determined from step 202 prior to the fixing operation. Finally, in step 206, imaging is performed on print media 28.

A third embodiment of the fixing device bias control system would combine features of the first embodiment and the second embodiment. In the third embodiment of the fixing device bias control system, the bias supplied to fuser 44 would be based upon determining whether print media 28 was making a second pass through the fixing process and based upon a value of either a voltage (if a current source supplies transfer roller 36) or a current (if a voltage source supplies transfer roller 36) supplied to transfer roller 36.

The quality of the images formed using the principles disclosed in this specification are improved by limiting the magnitude of the bias that controller 66 will cause power supply 70 to supply to fuser 44. At least two problems can arise in supplying a bias to fuser 44 having a magnitude that exceeds a threshold value. Typically, pressure roller 46 will be electrically connected to the chassis of electrophotographic printer 10 and therefore held at ground while a bias is supplied to fuser 44. Therefore an electric field is present between fuser 44 and pressure roller 46. The spatial variation of the electric field resulting from this bias depends upon the dielectrics involved (of pressure roller 46, fuser 44, print media 28, and air), the geometries involved, and the magnitude of the bias. If the magnitude of the bias applied is sufficiently large, dielectric breakdown will result. With dielectric breakdown, charge could flow from fuser 44 to print media 28, pressure roller 46, or both. This charging could disrupt the position of toner particles on print media 28, thereby degrading the image quality or causing image defects. In addition, this charging could impart a charge onto print media 28 that would make movement of print media 28 through the media path more difficult (because of electrostatic attraction to various assemblies near the media path).

Magnitudes of bias less than that necessary to cause dielectric breakdown may also cause image defects. Dependent upon the geometry of fuser 44 and pressure roller 46, there will be fringing of the electric field lines between fuser 44 and pressure roller 46. Because of the fringing, the force exerted by the electric field upon toner on the surface of print media 28 will have a component parallel to the surface of print media 28. If the magnitude of this component is sufficiently large, toner on the surface of print media 28 will be moved, thereby causing a degradation in image quality. The magnitude of the electric field component parallel to the surface of print media 28 is related to the magnitude of the bias between fuser 44 and pressure roller 46. The bias at which the magnitude of the parallel component of the field is sufficiently large to cause image degradation can be empirically determined, or mathematically determined if the models are sufficiently accurate.

Use of a time varying bias may allow the application of a higher magnitude bias without causing dielectric breakdown. Depending upon the materials and geometries involved, reduction of toner contamination may be more effectively achieved by using a higher magnitude time varying bias than a lower magnitude substantially non-time varying bias just below the threshold of dielectric breakdown. In addition, depending on the frequency of the time varying bias, use of a time varying bias may allow application of higher magnitude bias without causing scattering of toner on print media 28 than the magnitude of bias that could be used for a substantially non-time varying bias without toner scattering.

Typically fuser 44 and pressure roller 46 may be constructed to include compliant materials, such as rubber. To control the electric field applied between fuser 44 and pressure roller 46, compliant materials having some conductivity may be used. Using materials having conductivity on the outer layers of fuser 44 and pressure roller 46 may help in reducing electric field fringing.

Although several embodiments of the invention have been illustrated, and their forms described, it is readily apparent to those of ordinary skill in the art that various modifications may be made to these embodiments without departing from the spirit of the invention or from the scope of the appended claims.

What is claimed is:

1. A method for reducing contamination from toner in an electrophotographic imaging device, comprising:

determining a value of a parameter related to resistivity of media; and supplying a bias to a fixing device based upon the value of the parameter.

2. The method as recited in claim 1, further comprising:

determining a value of the bias to supply to the fixing device based upon the value of the parameter with determining the value of the bias occurring after determining the value of the parameter.

3. The method as recited in claim 2, wherein:

determining the value of the parameter includes determining a magnitude of a voltage supplied to a transfer device by a power supply.

4. The method as recited in claim 3, wherein:

determining the value of the bias includes accessing stored information to obtain the value of the bias based upon the magnitude of the voltage.

5. The method as recited in claim 2, wherein:

determining the value of the parameter includes determining a magnitude of a current supplied to a transfer device by a power supply.

6. The method as recited in claim 5, wherein:

determining the value of the bias includes accessing stored information to obtain the value of the bias based upon the magnitude of the voltage.

7. The method as recited in claim 2, wherein:

determining the value of the parameter includes determining an exposure of the media to heat from the fixing device.

8. The method as recited in claim 7, wherein:

determining the value of the bias includes selecting from a first value with an absence of the exposure of the media to the heat from the fixing device and selecting from a second value with a presence of the exposure of the media to the heat from the fixing device; and the bias includes a time varying bias.

9. A fixing device bias control system for use in an electrophotographic imaging device including a fixing device to fix toner to media, comprising:

a power supply to provide a bias to the fixing device; and a controller configured to determine a parameter related to resistivity of the media, with the controller for configuring the power supply to supply the bias to the fixing device based upon the parameter.

10. The fixing device bias control system as recited in claim 9, wherein:

the controller includes a configuration to determine the parameter using information received by the controller indicating a presence or an absence of an exposure of the media to heat from the fixing device; and the controller includes a configuration to set the bias based upon the presence or the absence of the exposure of the media to the heat from the fixing device.

11. The fixing device bias control systems as recited in claim 10, wherein:

with the presence of the exposure of the media to the heat from the fixing device, the controller includes a configuration to set the bias to a first value and with the absence of the exposure of the media to the heat from the fixing device, the controller includes a configuration to set the bias to a second value.

12. The fixing device bias control system as recited claim 9 with the electrophotographic imaging device including a photoconductor and a transfer device to transfer toner from the photoconductor to the media, wherein:

the parameter includes a voltage supplied to the transfer device; and the controller includes a configuration to set the bias based upon the voltage.

13. The fixing device bias control system as recited in claim 9 with the electrophotographic imaging device including a photoconductor and a transfer device to transfer toner from the photoconductor to the media, wherein:

the parameter includes a current supplied to the transfer device;

the controller includes a configuration to set the bias based upon the current; and the bias includes a substantially non-time varying bias.

14. The fixing device bias control system as recited in claim 9 with the electrophotographic imaging device including a photoconductor and a transfer device for transferring toner from the photoconductor to the media, wherein:

where the parameter corresponds to a first parameter, the controller includes a configuration to determine a second parameter using information received by the controller indicating a presence or an absence of an exposure of the media to heat from the fixing device; and the first parameter includes a voltage supplied to the transfer device, with the controller configured to supply the bias to the fixing device based upon the first parameter and the second parameter.

15. An electrophotographic imaging device to form an image on media using toner, comprising:

a photoconductor;

a photoconductor exposure device to form a latent electrostatic image on the photoconductor;

a developing device to develop the toner onto the media;

a transfer device to transfer the toner from the photoconductor to the media;

a fixing device to fix toner to the media; and a fixing device bias control system to provide a bias to the fixing device based upon a value of a parameter related to a resistivity of the media.

16. The electrophotographic imaging device as recited in claim 15, wherein:

the fixing device bias control system includes a power supply to provide the bias to the fixing device and a controller configured to determine the value of the parameter and configured to set the bias supplied by the power supply to the fixing device using the value of the parameter.

17. The electrophotographic imaging device as recited in claim 16, wherein:

the parameter includes a voltage supplied to the transfer device.

18. The electrophotographic imaging device as recited in claim 16, wherein:

the parameter includes a current supplied to the transfer device.

19. The electrophotographic imaging device as recited in claim 16, wherein:

the controller includes a configuration to determine the parameter using information received by the controller indicating a presence or an absence of an exposure of the media to heat from the fixing device; and the controller includes a configuration to set the bias based upon the presence or the absence of the exposure of the media to the heat from the fixing device.

20. The electrophotographic imaging device as recited in claim 19, wherein:

with the presence of the exposure of the media to the heat from the fixing device, the controller includes a configuration to set the bias to a first value and with the absence of the exposure of the media to the heat from the fixing device, the controller includes a configuration to set the bias to a second value.

* * * * *